US006478718B2

(12) United States Patent
Rich

(10) Patent No.: US 6,478,718 B2
(45) Date of Patent: Nov. 12, 2002

(54) MOUNTING PLATFORM FOR TRAMPOLINES

(76) Inventor: R. Wayne Rich, 1201 N. Washington St., Sylvester, GA (US) 31791

( * ) Notice: Subject to any disclaimer, the term of this patent is extended or adjusted under 35 U.S.C. 154(b) by 32 days.

(21) Appl. No.: 09/501,302

(22) Filed: Feb. 9, 2000

(65) Prior Publication Data

US 2001/0051560 A1 Dec. 13, 2001

Related U.S. Application Data

(60) Provisional application No. 60/119,289, filed on Feb. 9, 1999.

(51) Int. Cl.[7] ..... A63B 5/11
(52) U.S. Cl. ..... 482/29; 182/116; 182/187
(58) Field of Search ..... 482/27–32; 182/116, 182/129, 187, 115, 188, 133, 135, 164; 108/156

(56) References Cited

U.S. PATENT DOCUMENTS 2,324,970 A * 7/1943 Woolley ..... 482/27
2,858,132 A * 10/1958 Sidlinger ..... 482/27
3,092,383 A * 6/1963 Dunn ..... 482/32
4,477,070 A * 10/1984 Appelbaum ..... 482/28
5,267,632 A * 12/1993 Mintz ..... 182/116
5,564,524 A * 10/1996 Thaggard et al. ..... 182/116

* cited by examiner

*Primary Examiner*—Jerome W. Donnelly
*Assistant Examiner*—Lori Baker Amerson
(74) *Attorney, Agent, or Firm*—Connolly Bove Lodge & Hutz

(57) ABSTRACT

A mounting platform is provided for access to a trampoline or similar exercise device. The mounting platform removably attaches to the side of the trampoline to provide a horizontal surface from which an individual can move onto or off of the trampoline. An adjustable ladder provides access to the platform and, in one embodiment, can be folded under the platform, which itself can be removed from the trampoline or collapsed to a vertical position when not in use.

21 Claims, 2 Drawing Sheets

MOUNTING PLATFORM FOR TRAMPOLINES

BACKGROUND OF THE INVENTION

This application claims the benefit of Provisional Application Ser. No. 60/119,289 filed February 9, 1999, the content of which is incorporated by reference herein in its entirety.

Field of the Invention The present invention is directed to a platform for use in conjunction with a trampoline or similar exercise device. More particularly, the present invention is directed to a platform for attachment to the frame of a trampoline-type device to facilitate access to and use of the device.

Background of the Related Art

Because the surface of a trampoline must be elevated and is inherently unstable due to its necessary resilience, access to the trampoline, as well as exiting from the trampoline at the conclusion of exercise, can be a somewhat difficult and potentially dangerous operation. Further, these same aspects of the trampoline can impede individuals providing assistance or training to the user of the trampoline.

Accordingly, it would be desirable to provide a readily attachable and removable platform that could be adjusted in height and positioned at the side and at approximately the same height as the frame of the trampoline both to facilitate use of the trampoline and to place the observer or assistant in a position proximate to the trampoline user.

SUMMARY OF THE INVENTION

To achieve these objects and in accordance with the purpose of the invention as embodied and broadly described herein, the present invention provides a platform for use with and attachment to a trampoline. The device of the invention is adjustable in height to accommodate trampolines disposed at different heights and is provided with a provision for attachment to the side of the frame supporting the trampoline so that the platform is immediately adjacent the trampoline and at substantially the same height. A ladder is pivotally attached to one side of the platform structure to provide access to the surface of the platform and to permit the platform to be folded down from the horizontal to vertical position. The ladder can also provide support for a side of the platform. Pivotal attachment of the ladder permits the ladder to automatically adjust for differences in height of the platform and to be folded up under the platform.

It is to be understood, however, that both the foregoing general description and the following detailed description are exemplary and explanatory and are not restrictive of the invention.

The accompanying drawings, which are incorporated in and constitute a part of this specification, illustrate a preferred embodiment of the invention and together with the description serve to explain the principles of the invention.

DESCRIPTION OF A PREFERRED EMBODIMENT OF THE INVENTION

Reference will now be made in detail to a present preferred embodiment of the invention as illustrated in the accompanying drawings. Whenever possible, the same reference numbers will be used throughout the drawings to refer to the same or like parts.

Figure 1:
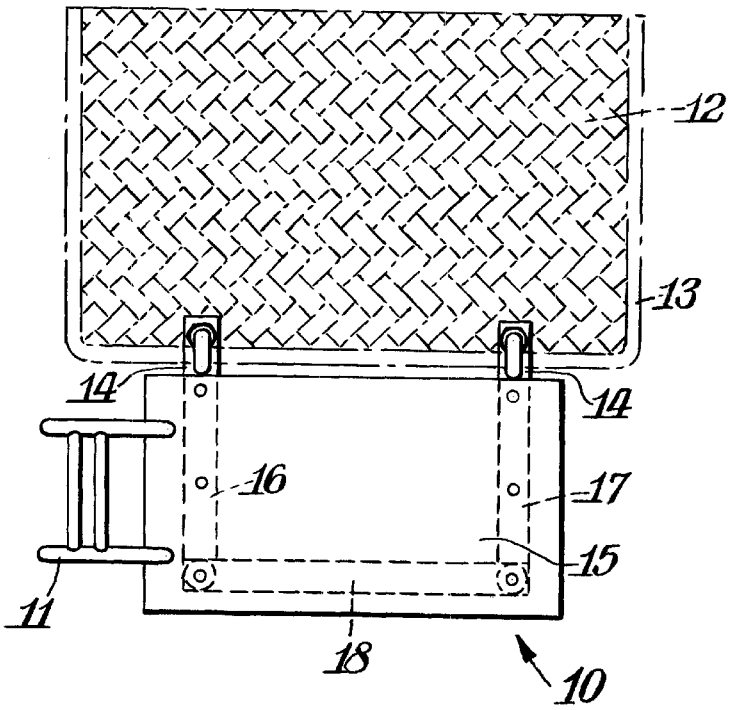
FIG. 1 is a top view of a trampoline mounting platform according to an embodiment of the present invention.
Figure 2:
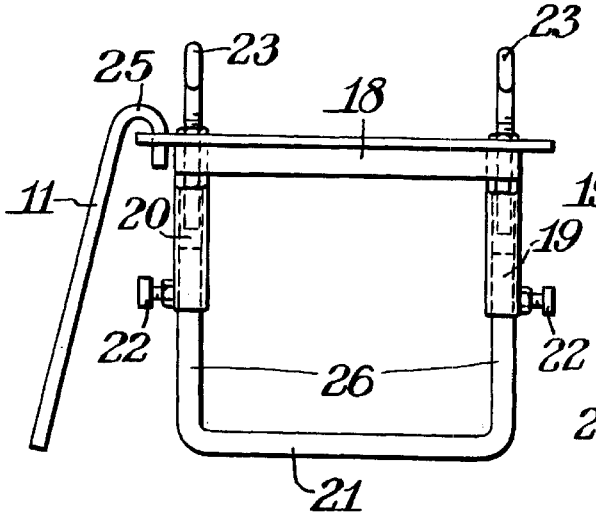
FIG. 2 is a front view of the mounting platform of FIG. 1.
Figure 3:
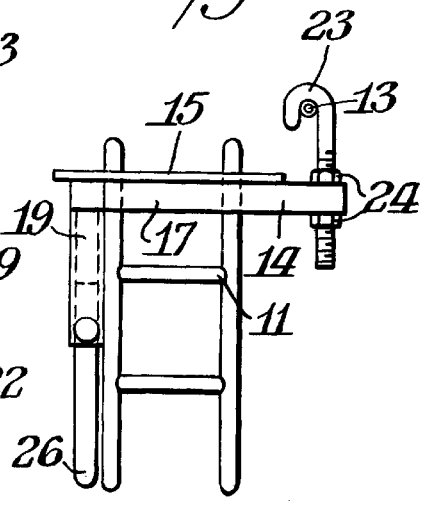
FIG. 3 is a side view of the mounting platform of FIG. 1.

In accordance with the present invention, an elevated mounting platform for attachment to the side of a trampoline frame is provided. As illustrated in FIGS. 1-3 of the drawings, the mounting platform in accordance with one embodiment of the invention is shown generally at 10 and comprises a generally flat, horizontal top surface 17 suitable for at least one individual to stand on. Shown in phantom and not a part of the present invention is trampoline mat 12 having a surrounding rigid frame 13. As particularly shown in FIG. 3 of the drawings, the platform surface 15 is horizontally disposed at approximately the level of the trampoline mat in order to facilitate entry or exit of an individual onto or from the trampoline mat.

As further seen in FIGS. 2 and 3 of the drawings, the elevated platform surface 15 is accessible by means of ladder 11. Since trampolines and their supporting frame must be elevated a distance above ground level, the height of the mounting platform of the invention is also adjustable to the height of the trampoline frame. Sockets 19 and 20 attach to intersecting frame supports 16, 17, and 18 and receive two up-turned leg elements 26, respectively, of U-shaped support member 21. A pair of adjustable set screws or similar locking members are provided at 22 to lock the leg elements 26 of U-shaped member 21 into the desired position in sockets 19 and 20, thereby permitting vertical adjustment of the height of the platform.

At the opposite side of the platform from the leg supports 19, 20, and 21, two vertically aligned elongated attachment hooks or clasps 23 are provided to engage with the frame member 13 of the trampoline thereby providing support for the side of the mounting platform adjacent to the trampoline. In order to permit vertical adjustment of the trampoline frame engagement hooks 23, a portion of the shank of the hook can conveniently be threaded and adjustable nuts 24 provided to permit vertical adjustment and locking of the attachment hook so that it engages the trampoline frame as illustrated in FIG. 3 of the drawings. It will be understood that other devices can as well be used to adjust and fix the height of the hooks 23. The two side support members 16 and 17 of the platform extend beyond the surface of the platform 15 to provide extensions 14 to accommodate passage of the trampoline frame engagement hooks 23. Horizontal support member 18 is disposed on the underside of the platform surface 15 and in engagement with the respective ends of the support members 16 and 17 remote from the trampoline attachment. To accommodate ladder 11, one side of the platform surface 15 is provided with a pair of holes 26 and the two top portions 25 of the sides of ladder 11 are downwardly turned to permit engagement into the respective holes. Alternatively, the top of ladder 11 can be attached in other suitable ways to provide engagement with the platform surface 15 that is sufficiently loose and flexible to permit outward or inward pivotal movement away from or toward the platform frame as the height of the platform is varied to accommodate the height of the trampoline. To further facilitate adjustment of the ladder, the length of the ladder's sides can be made extensible.

Figure 6:
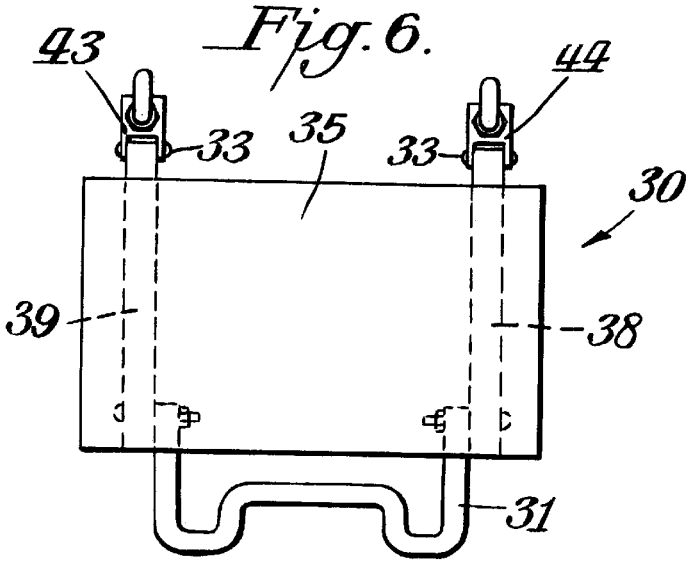
FIG. 6 is a top view of the mounting platform of FIG. 4.
Figure 4:
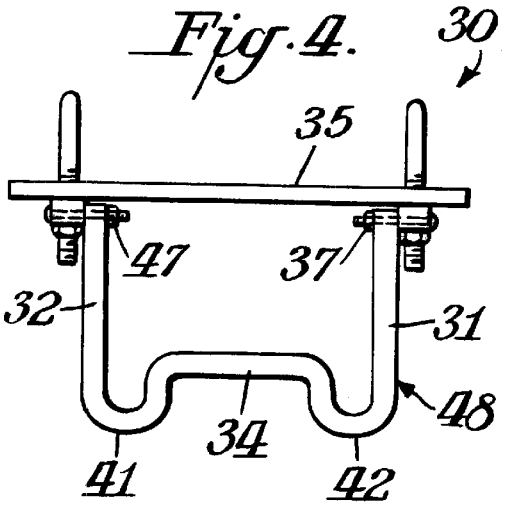
FIG. 4 is a front view of a trampoline mounting platform according to a second embodiment of the invention.
Figure 5:
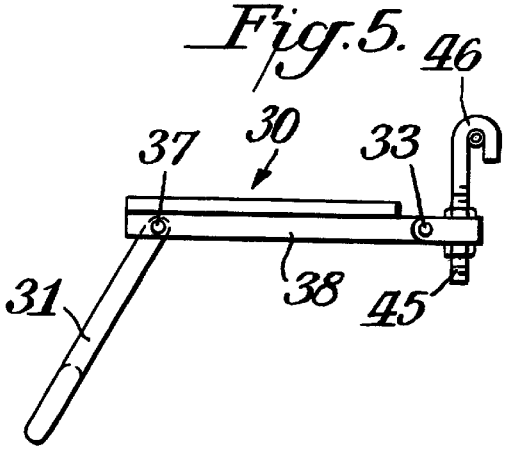
FIG. 5 is a side view of the mounting platform of FIG. 4.

FIGS. 4, 5, and 6 illustrate an additional embodiment of the present invention whereby the platform support structure and the platform access ladder are a single unit which can be folded up under the platform when not in use. Platform surface 35 is supported by two parallel platform frame members 38 and 39. One end of each of the platform frame members 38 and 39 is pivotally attached at 44 and 43, respectively, to attachment hooks which engage over the edge of the trampoline as heretofore described. A generally U-shaped combined ladder and support structure 48 is pivotally engaged with the other ends of the platform frame members 38 and 39. The support structure/ladder 48 consists of two parallel legs 31 and 32 connected by a horizontal crosspiece 34 that is positioned to serve as a step for gaining access to the surface 35. The legs 31 and 32 and crosspiece 34 can be formed from a single member with appropriate bending or otherwise fabricated to suitably elevate the height of the crosspiece 34 above the respective feet 41 and 42 of the support structure/ladder 48. The ends 37 and 47 of the respective legs 31 and 32 of the support structure/ladder 48 are pivotally engaged with the platform frame members 38 and 39 at 37 and 47, respectively, so that the entire support structure/ladder can be folded up under the platform surface 35. As previously described, the hooks 45 have a threaded shank that permits the height of the inverted U-shaped portion of the hook to be adjusted up or down relative to the platform surface 35. In addition, the down turned leg of the hook, which fits over the trampoline frame, can be provided with a threaded bolt and plate, or other device, to permit the entire hook structure to be locked in place around the frame of the trampoline and to be loosened for removal. In accordance with this embodiment of the invention, it will be appreciated that, when not in use, the ladder/support 48 can be folded back up under the platform surface 35 and the entire structure pivoted downward around the hinges 33.

It will be appreciated that while the supporting frame structure of the mounting platform of the invention should be rigid and can be constructed of either solid or tubular materials, most desirably the surface of the platform will either be of resilient or padded construction both for comfort and safety although it will also be appreciated that it should be sufficiently rigid to support the weight of an individual standing on it.

It will further be appreciated that the mounting platform of the invention, in addition to facilitating access to the trampoline surface and allowing for the nearby presence of an instructor or aide, also provides a substantial safety factor by permitting the individual to rapidly, and without danger, either leave or be removed from the trampoline surface. The device of the invention has the further advantage of being of relatively simple construction that permits its quick and easy disassembly or assembly for storage and transportation.

It will be apparent to those skilled in the art that various modifications and variations can be made in the trampoline mounting platform of the present invention and in its construction without departing from the scope or spirit of the invention.

Other embodiments in the invention will be apparent to those skilled in the art form consideration of the specification and practice of the invention disclosed herein. It is intended that the specification and examples be considered as exemplary only.

What is claimed is:

1. An access platform for use with an elevated exercise structure, comprising: a generally flat, horizontal surface having a support base; a portion of said support base being provided with one or more fasteners for attaching the support base to a side of the elevated exercise structure; a vertical support attached to said support base at a position remote from said fasteners to maintain said horizontal surface at a desired height and position; and said fasteners are inverted hooks having shank portions that engage with said support base and inverted U-shaped portions that engage over the side of the elevated exercise structure.

2. The access platform of claim 1 wherein said shank portions are vertically adjustable with respect to said support base.

3. A combination exercise structure and access platform comprising an exercise structure having a frame and an elevated surface, an access platform disposed adjacent to said frame, said access platform including support base having a generally flat and generally horizontal support surface, said support base having a first portion located at said frame and a second portion remote from said first portion, at least one fastener connected to said first portion and mounted to said frame whereby said frame provides a first location of support for said support base, an access ladder mounted to said second portion of said support base and extending below said support base, said access ladder providing a second location of support for said support base whereby said frame and said access ladder in combination jointly maintain said support base in an elevated position, said ladder comprising two parallel legs connected to one another by a horizontal crosspiece, said fastener comprising inverted hooks having shank portions that engage with said support base and inverted U-shaped portions that engage over the side of the elevated exercise structure, and said fastener being pivotally attached to said support base.

4. An access platform for use with an elevated exercise structure, comprising:

a generally flat, horizontal surface disposed on a support base;

one or more fasteners for attaching a side of the platform to a side of the elevated exercise structure, said fasteners being pivotally attached to said support base; and a vertical support pivotally attached to said support base at a position remote from said fasteners to maintain said horizontal surface at a desired height and position, said vertical support comprising two parallel legs connected with one another by a horizontal crosspiece, said legs and crosspiece, when generally vertically disposed, forming a ladder for access to said horizontal surface.

5. An access platform for use with an elevated exercise structure, comprising a support base having a generally flat and generally horizontal support surface, a vertical support disposed below and supporting said support base to dispose said support base at an elevated position, said vertical support including two sets of multi-piece support members spaced from each other and rigidly mounted to and supporting said support base at locations remote from each other, said support members in each of said sets being vertically slidable with respect to each other to selectively adjust the height of said elevated position, at least one fastener secured to said support base for detachably mounting said support base to the exercise structure, in combination with an exercise structure having a frame and an elevated surface, and said fasteners, comprising inverted hooks having shank portions that engage with said support base and inverted U-shaped portions that engage over the side of the elevated exercise structure, being detachably mounted to said frame.

6. The access platform of claim 1 which further includes a vertically disposed ladder having a top portion which engages with a portion of the platform.

7. The access platform of claim 6 wherein said rigid frame comprises at least two spaced apart, parallel horizontal members, each having an end that extends beyond said horizontal surface to engage with said fasteners.

8. The access platform of claim 1 wherein said vertical support comprises two parallel legs connected to one another by a horizontal crosspiece.

9. An access platform of claim 5 wherein said fastener is vertically adjustable in length.

10. The access platform of claim 5 wherein a side of said support base includes a plurality of extensions, said at least one fastener comprising a plurality of fasteners, each of said fasteners being mounted to a respective one of said extensions, and each of said fasteners having attaching structure disposed above said extensions for mounting said fasteners to the exercise structure.

11. An access platform for use with an elevated exercise structure, comprising a support base having a generally flat and generally horizontal support surface, a vertical support disposed below and supporting said support base to dispose said support base at an elevated position, said vertical support including two sets of multi-piece support members spaced from each other and rigidly mounted to and supporting said support base at locations remote from each other, said support members in each of said sets being vertically slidable with respect to each other to selectively adjust the height of said elevated position, at least one fastener secured to said support base for detachably mounting said support base to the exercise structure, and said fastener including a hook end for hooking over a portion of the exercise structure.

12. The access platform of claim 5 including an access ladder pivotally mounted to said support base.

13. The combination of claim 5 wherein said exercise structure is a trampoline.

14. A combination exercise structure and access platform comprising an exercise structure having a frame and an elevated surface, an access platform disposed adjacent to said frame, said access platform including support base having a generally flat and generally horizontal support surface, said support base having a first portion located at said frame and a second portion remote form said first portion, at least one fastener connected to said first portion and mounted to said frame whereby said frame provides a first location of support for said support base, an access ladder mounted to said second portion of said support base and extending below said support base, said access ladder providing a second location of support for said support base whereby said frame and said access ladder in combination jointly maintain said support base in an elevated position and said fastener, comprising inverted hooks having shank portions that engage with said support base and inverted U-shaped portions that engage over the side of the elevated exercise structure, being detachably hooked on said frame.

15. The access platform of claim 14 wherein said support base comprises at least two spaced apart, parallel horizontal members, each having an end that extends beyond said horizontal surface to engage with said fasteners.

16. The combination of claim 14 wherein said exercise structure is a trampoline.

17. The access platform of claim 16 wherein said vertical support comprises two parallel legs connected to one another by a horizontal crosspiece.

18. The combination of claim 14 wherein said fastener is vertically adjustable in length.

19. A combination exercise structure and access platform comprising an exercise structure in the form of a trampoline having an elevated mat secured to a frame, an access platform disposed adjacent to said frame, said access platform including a support base having a generally flat and generally horizontal support surface, said support base having a vertical support disposed below and supporting said support base at an elevated location adjacent to said frame, at least one fastener mounting said support base to said frame, said fastener, comprising inverted hooks having shank portions that engage with said support base and inverted U-shaped portions that engage over the side of the elevated exercise structure, is being detachably mounted to said frame.

20. The combination of claim 19 including an elevating structure connected to said support base for permitting said support base to be selectively mounted to frames of different heights.

21. The combination of claim 19 including an access ladder mounted to said support base.

* * * * *